United States Patent [19]

Peters

[11] Patent Number: 4,674,308

[45] Date of Patent: Jun. 23, 1987

[54] LOCK COVER MECHANISM

[75] Inventor: Richard D. Peters, Worthington, Ohio

[73] Assignee: The D. L. Auld Company, Columbus, Ohio

[21] Appl. No.: 858,650

[22] Filed: May 2, 1986

[51] Int. Cl.[4] ..... E05B 17/18

[52] U.S. Cl. ..... 70/455; 70/423; 70/427

[58] Field of Search ..... 70/455, 423, 427

[56] References Cited

U.S. PATENT DOCUMENTS

| | | | |
|---|---|---|---|
| 2,213,814 | 9/1940 | Jacobi | 70/455 |
| 2,343,605 | 3/1944 | Wise | 70/455 |
| 2,391,498 | 12/1945 | Wise | 70/455 |
| 2,602,319 | 7/1952 | Jacobi | 70/455 |
| 3,313,136 | 4/1967 | Gulette et al. | 70/455 |
| 3,898,824 | 8/1975 | Borlinghaus | 70/455 |
| 3,930,391 | 1/1976 | Borlinghaus | 70/455 |
| 4,597,274 | 7/1986 | Coscia et al. | 70/455 |

*Primary Examiner*—Thomas J. Holko
*Assistant Examiner*—Suzanne L. Dino
*Attorney, Agent, or Firm*—Killworth, Gottman, Hagan & Schaeff

[57] ABSTRACT

A cover mechanism for covering a lock, having a key opening, on a lock support surface includes a cover plate which may be pivoted between a closed position in which the key opening of the lock is covered, and an opened position in which the key opening is exposed. A detent arrangement engages the cover plate at a first point to hold it in its opened position until a key is inserted into the key opening and rotated towards an unlatching position, whereupon the detent arrangement engages the cover plate at a second point and prevents movement of the cover plate into its closed position. The cover plate is released when the key is withdrawn from the lock such that the cover plate is free to move into its closed position.

17 Claims, 11 Drawing Figures

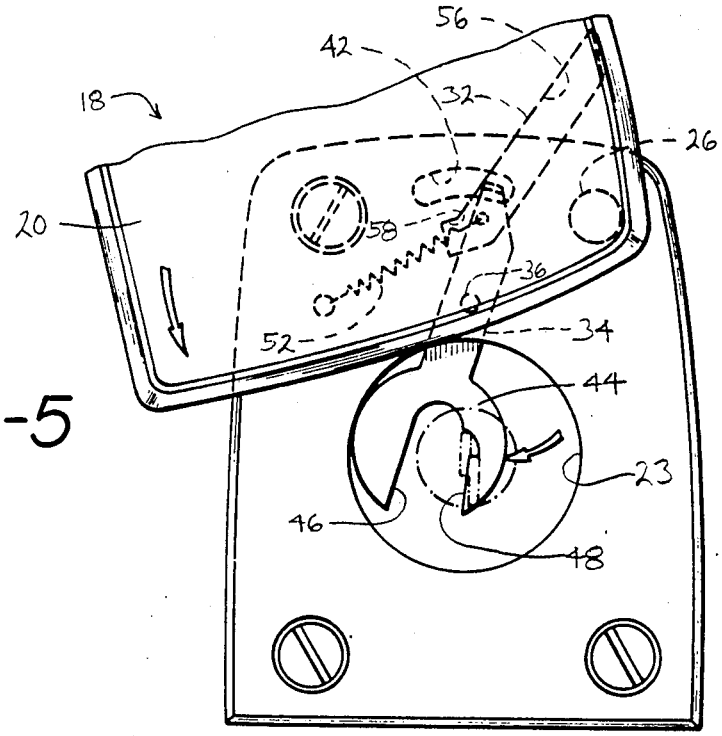
FIG-5
FIG-6
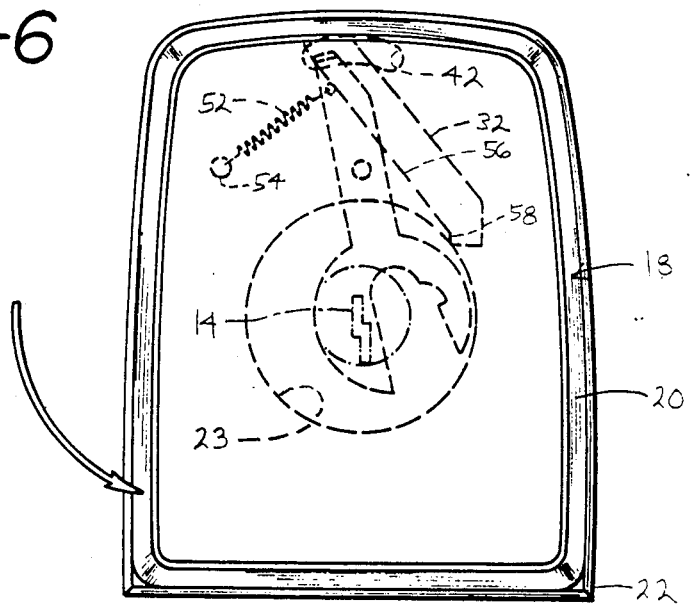

LOCK COVER MECHANISM

BACKGROUND OF THE INVENTION

The present invention is directed to a lock cover mechanism for covering a lock, including a lock cylinder having a key opening and, more particularly, to such a mechanism which includes a pivotally mounted cover plate, and a cover plate detent arrangement for holding the cover plate in an opened position during actuation of the lock.

Lock cover mechanisms of this type are commonly used to cover the key openings of locks which latch vehicle body deck lids. A number of different cover arrangements, including detented cover assemblies, have been used in the past to shield locks from inclement weather conditions. Such a cover assembly generally includes a support plate mounted on the lock or on the vehicle body deck lid. The support plate defines an access opening which is aligned with the lock key opening and through which a key is inserted into the lock. A cover plate is pivotally supported by the support plate and is moveable about an axis, generally normal to the plane of the cover plate, between an opened position in which a key may be inserted into the key opening, and a closed position in which the lock is completely covered.

One such detented cover assembly is disclosed in U.S. Pat. No. 3,898,824, issued Aug. 12, 1975, to Borlinghaus. In the U.S. Pat. No. 3,898,824 device, a leaf spring arrangement, mounted on the support plate, holds the cover plate open against the closing bias of a torsion spring after the cover has been manually opened. The leaf spring includes a detenting portion that is normally positioned in the path of the cover plate to prevent the plate from rotating into its closed position. The leaf spring further includes a portion adapted to be engaged and pushed outwardly from the deck lid by a cam on the lock cylinder as the cylinder is rotated into its unlocked position. The outward camming of this portion of the leaf spring causes the detenting portion of the leaf spring to be moved inwardly toward the deck lid so that the cover plate is released and then closed under the bias of the torsion spring.

The U.S. Pat. No. 3,898,824 cover assembly is disadvantageous in that the cover plate is released to move toward its closed position when the lock cylinder is rotated fully. At this point the key is still in the key opening, and the cover plate therefore pivots into contact with the key. The key must then be rotated back to its vertical position and withdrawn from the key opening. Both of these steps are hindered by the key being contacted by the cover plate. Additionally, if the key is a two-sided key, over a period of time the rubbing of the upper serrated edge of the key across the edge of the cover plate may damage the key and the plate. This detented cover assembly is further disadvantageous in that it requires a specially configured lock cylinder.

U.S. Pat. No. 3,930,391, issued Jan. 6, 1976, to Borlinghaus discloses a similar cover arrangement. In the U.S. Pat. No. 3,930,391 arrangement, however, an engagement portion of the leaf spring is positioned to contact the body of the key as the lock cylinder is rotated during the unlocking operation. While not requiring a specially configured lock cylinder, the U.S. Pat. No. 3,930,391 arrangement is disadvantageous in that the cover plate is released when the key and lock cylinder are fully rotated, permitting the cover plate to pivot toward its closed position and strike the key. Thus, deterioration of the key and the cover plate over a period of time may result as the key is repeatedly withdrawn from the key opening. Additionally, the force of the cover plate pressing against the side of the key may inhibit the reverse rotation of the key back to its vertical position prior to withdrawal of the key from the lock.

Accordingly, it is seen that there is a need for a cover mechanism for covering a lock in which the cover plate is held in its opened position during actuation of the lock.

SUMMARY OF THE INVENTION

A cover mechanism according to the present invention which meets this need covers a lock, including a lock cylinder having a key opening, which is mounted on a lock support surface. The mechanism includes a cover plate means having a cover plate, pivotally mounted on a support plate secured to the lock support surface, for rotation generally in the plane of the cover plate between the closed position in which the lock is covered, and in opened position in which the lock is exposed through insertion of a key into the key opening. The cover plate means further includes a spring means for spring biasing the cover plate toward its closed position. The cover mechanism includes a plate detent means for engaging the cover plate at a first point after the cover plate is pivoted into its opened position, thereby holding the cover plate in the opened position, for engaging the cover plate at a second point in response to insertion of a key into the key opening and rotation of the key from an initial position toward an unlatching position, the detent means contacting the key in the key opening so as to be held in position to engage the cover plate at the second point, and for thereafter releasing the cover plate removing the plate detent means out of the path of the cover plate as the key is removed, such that the cover plate may then be rotated into the closed position by the spring means.

The support plate defines an access opening aligned with the key opening. The cover plate defines a channel in the side thereof facing the support plate. The cover detent means comprises a detent member pivotally mounted on the support plate. The detent member includes a leg having a stop thereon extending into the channel. The detent member further includes a contact portion defining a pair of key contact surfaces on opposite sides of a key aperture. The contact portion is generally aligned with the access opening. The cover detent means further comprises a spring which pivotally biases the detent member to bring the stop into contact with the first and second points in the channel. As a result, the key contacts the first of the key contact surfaces and moves the stop out of contact with the first point as the key is rotated. The detent member is held with the stop against the second point by contact of the second of the contact surfaces with the key. Withdrawal of the key from the key opening then permits the stop to move out of contact with the second point and allows the cover to rotate into its closed position. The slot may be generally straight, with the second point defined on the wall of the slot, and with the slot having a notch at an end thereof defining the first point. The contact portion may define an open ended key aperture between the key contact surfaces.

Accordingly, it is an object of the present invention to provide a cover mechanism for covering a lock, including a cover plate which is pivotally mounted for rotation generally in the plane of the cover plate between a closed position and an opened position, in which a plate detent means holds the cover plate in the opened position until a key is withdrawn; and to provide such a mechanism in which a stop contacts the cover plate at a first point and holds the cover plate in its opened position until the key is inserted into the lock and rotated, and then the stop contacts the cover plate at a second point and holds the cover plate in its opened position until the key is returned to its original position, and withdrawn.

Other objects and advantages of the invention will be apparent from the following description, the accompanying drawings and the appended claims.

BRIEF DESCRIPTION OF THE DRAWINGS

FIG. 5 is a front view, similar to FIG. 1, illustrating movement of the stop away from the second point by withdrawal of the key; and FIG. 6 is a front view, similar to FIG. 1, illustrating pivoting of the cover plate into its closed position.

DETAILED DESCRIPTION OF THE PREFERRED EMBODIMENT

Figure 2:
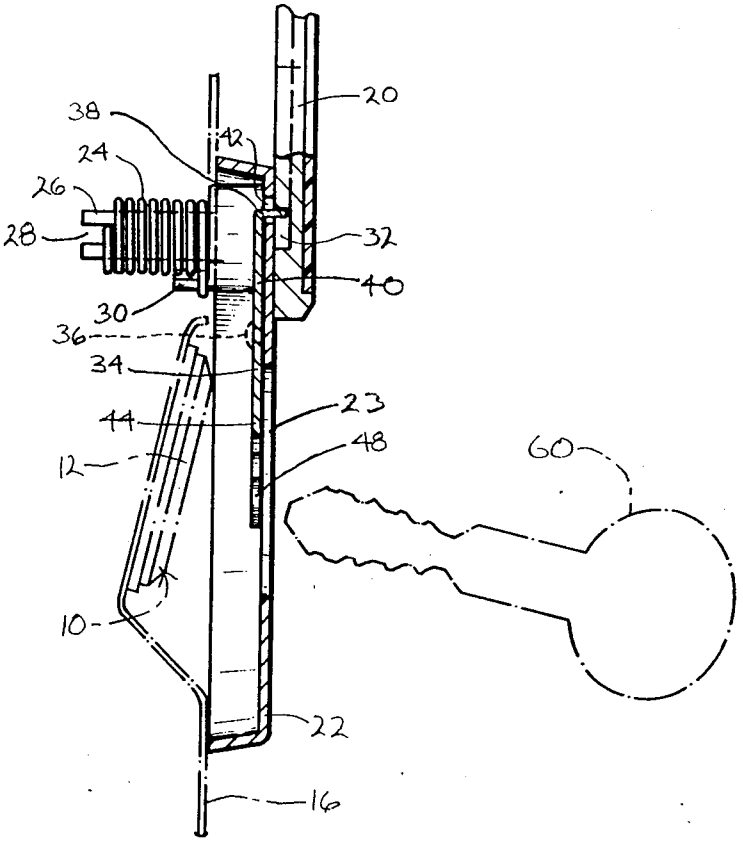
FIG. 2 is a sectional view, taken generally along line 2—2 in FIG. 1.

FIGS. 1–6 illustrate a first embodiment of a cover mechanism, constructed according to the present invention, for covering a lock 10 including a lock cylinder 12 having a key opening 14. The cover mechanism and the lock 10 are mounted on a lock support surface 16. A cover plate means 18, including a cover plate 20, is pivotally mounted on a support plate 22 for rotation generally in the plane of the cover plate 20. The cover plate 20 is rotatable between a closed position, indicated in FIG. 6, in which the lock 10 is covered, and an opened position, shown in FIG. 1, in which the lock 10 is exposed for insertion of a key into the key opening 14. The support plate 22 defines an access opening 23 which is aligned with the key opening 14.

The cover plate means has a spring means, including spring 24, spring biasing the cover plate 20 toward its closed position. The spring means further includes a pivot shaft 26 which extends rearwardly from the cover plate 20 through a hole in the support plate 22. Spring 24 is coiled about shaft 26 and attached at one end in slot 28 and at its opposite end to the support plate 22 at projection 30.

Cover plate 20 defines a channel 32 on the side of plate 20 facing plate 22. Channel 32 cooperates with a detent member 34 to hold the cover plate 20 in its opened position during actuation of the lock, as more fully described below. Detent member 34 is pivotally mounted on support plate 22 by means of rivet post 36. The detent member includes a stop 38 at the upper end of leg 40 which, as best seen in FIG. 2, extends through opening 42 in plate 22 into channel 32. Additionally, the detent member includes a lower contact portion 44, which defines a pair of key contact surfaces 46 and 48 on opposite sides of key aperture 50. A spring 52 biases the detent member in a generally counter clockwise direction, as seen in FIGS. 1 and 3–6. Spring 52 is connected between leg 40 and a stud 54 on the back of plate 22. As a result, stop 38 is urged against wall 56 of channel 32.

Figure 1:
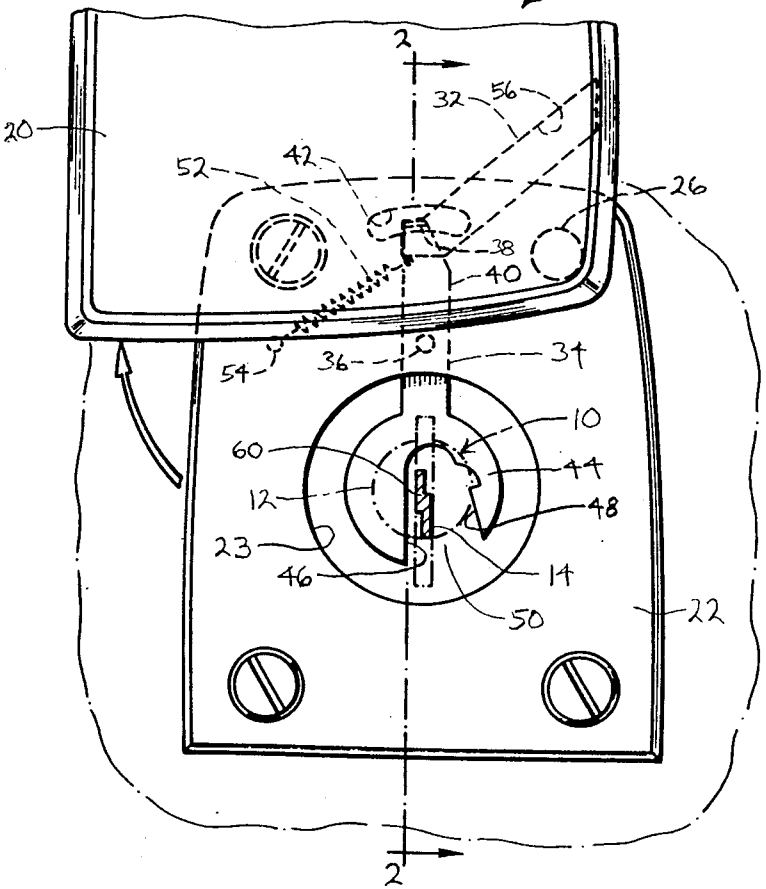
FIG. 1 is a front view of a first embodiment of a cover mechanism constructed according to the present invention, with the cover plate in its opened position; held by a stop contacting the cover plate at a first point.
Figure 3:
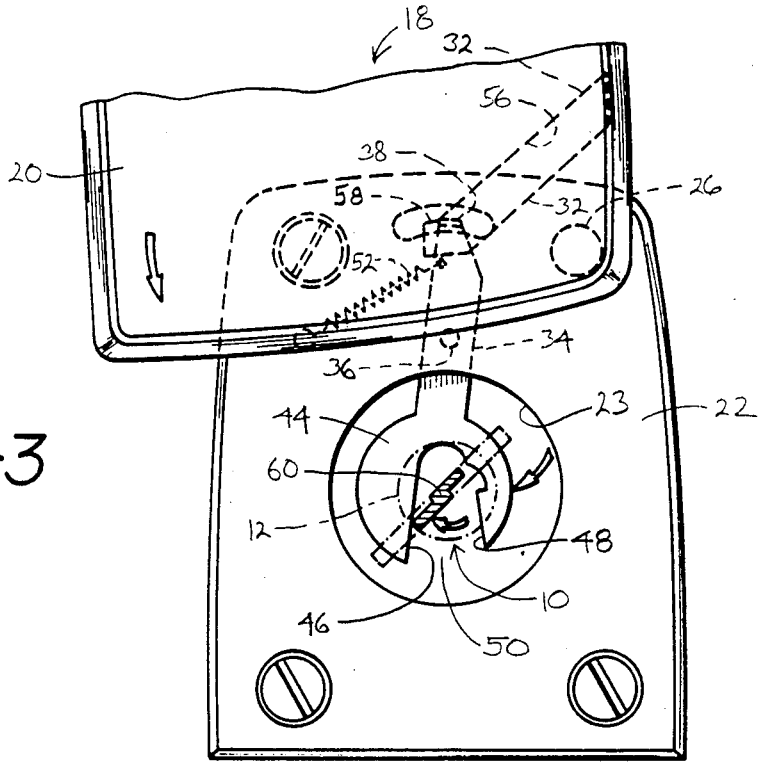
FIG. 3 is a front view, similar to FIG. 1, illustrating movement of the stop away from the first point by rotation of the key.

Initially, cover plate 20 is in its closed position, illustrated in FIG. 6. As cover plate 20 is rotated into its opened position, shown in FIG. 1, stop 38 slides along the channel 32 in contact with channel wall 56. When the plate 20 reaches its opened position, the stop 38 is brought into contact with a first point in the channel 56, defined by notch 58 (FIG. 3). The stop 38 then remains in this position, as shown in FIG. 1, preventing closure of cover plate 20.

Figure 4:
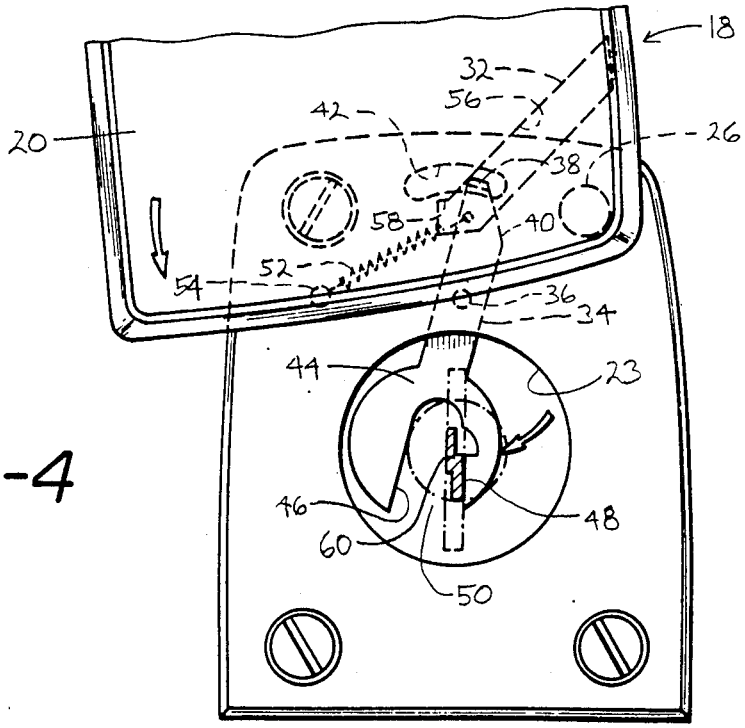
FIG. 4 is a front view, similar to FIG. 1, illustrating engagement of the cover plate by the stop at a second point.
Figure 7:
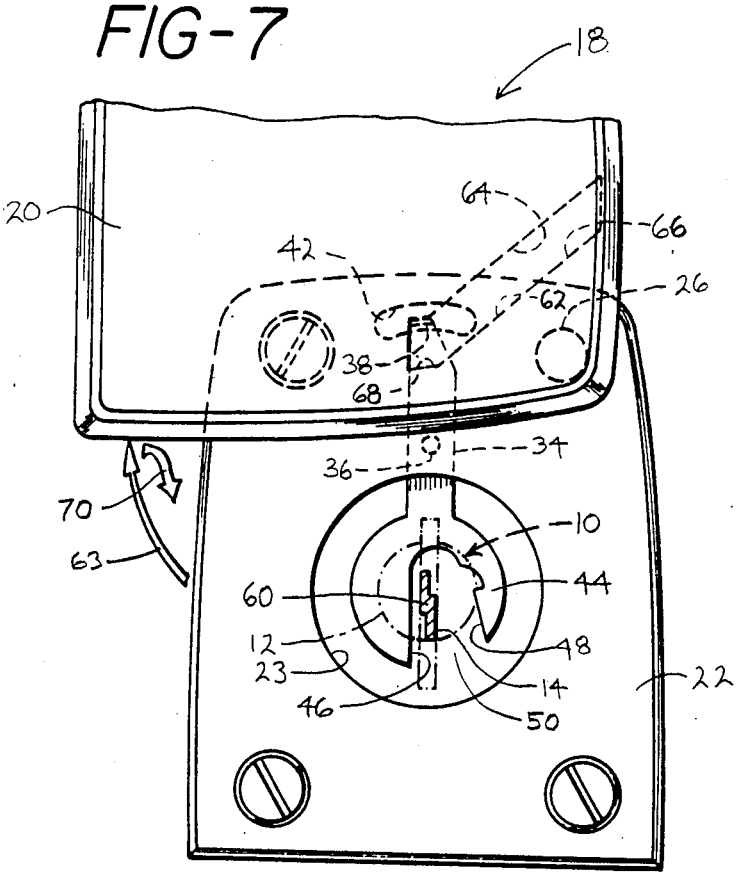
FIG. 7 is a front view of a second embodiment of a cover mechanism constructed according to the present invention, with the cover plate in its opened position, held by a stop contacting the cover plate at a first point.

When key 60 is inserted into the lock and rotated, as shown in FIG. 3, the key strikes contact surface 46, causing the detent member 34 to pivot as shown in FIG. 3, and moving stop 38 out of notch 58. The cover plate 20 then pivots slightly toward its closed position, as shown in FIG. 4, until contact surface 48 contacts the other side of key 60. At this point, further pivotal movement of detent member 34 is prevented. As a consequence of the contact between stop 38 and a second point along the channel wall 56, further pivotal movement of plate 20 is also precluded. However, after the key 60 is withdrawn from the lock, as shown in FIG. 5, the detent member 34 is free to pivot further in a clockwise direction, allowing the cover plate 20 to pivot into its closed position.

It will be appreciated that this embodiment of the cover mechanism of the present invention precludes contact between the cover plate 20 and the key 60. Although the side of key 60 does contact surface 48 as the key is withdrawn from the lock, wear of the serrated edges of the key does not occur. Additionally, only a light force is applied to the side of the key 60 by surface 48 with a result that the key 60 may be easily withdrawn from the lock.

Reference is now made to FIGS. 7–11 which illustrate a second embodiment of the present invention. This embodiment is similar in some respects to the first embodiment of FIGS. 1–6, and like reference numerals have been used in FIGS. 7–11 to identify corresponding structural elements. The second embodiment differs in structure from the first embodiment, however, in that spring 52 is omitted and the channel or groove 62 defined by cover plate 20 in the second embodiment has a slightly different shape.

Figure 11:
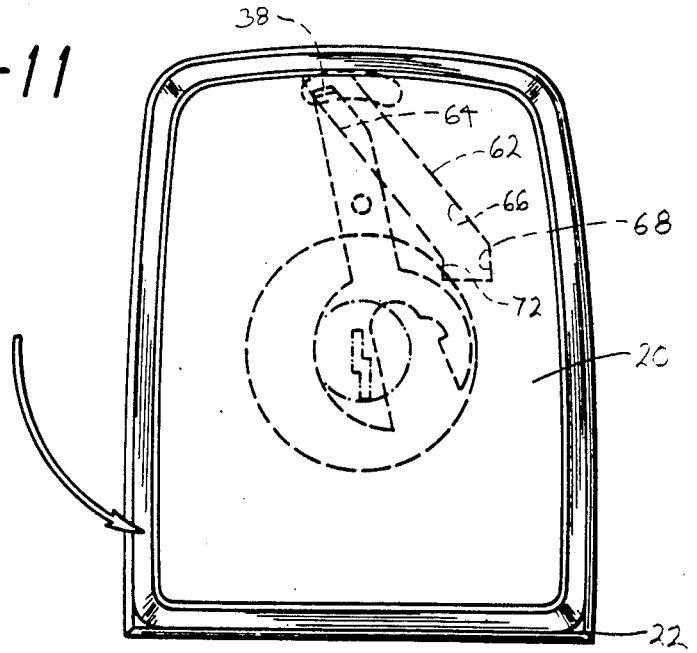
FIG. 11 is a front view, similar to FIG. 7, illustrating pivoting of the cover plate into its closed position.

Initially, cover plate 20 is in its closed position, as illustrated in FIG. 11. Cover plate 20 is then manually pivoted in a clockwise direction toward its opened position, indicated by arrow 63 in FIG. 7. As cover plate 20 is pivoted, stop 38 initially slides along wall 64 of groove 62. As the cover plate 20 moves toward its opened position, stop 38 is contacted by wall 66 of groove 62 and is cammed onto surface 68 in the notched end of the groove 62. At this point, further pivotal movement of cover plate 20 in a clockwise direction is prevented by surface 68 contacting the stop 38. When the cover plate 20 is then manually released, it pivots slightly in a counter-clockwise direction, indicated by arrow 70 in FIG. 7, and stop 38 then contacts the surface 72 in the notched end of groove 62 which opposes surface 68. The cover plate 20 is held in its opened position by the stop 38 against the opposing spring force of spring 24 (not shown) which encircles pivot shaft 26.

Figure 8:
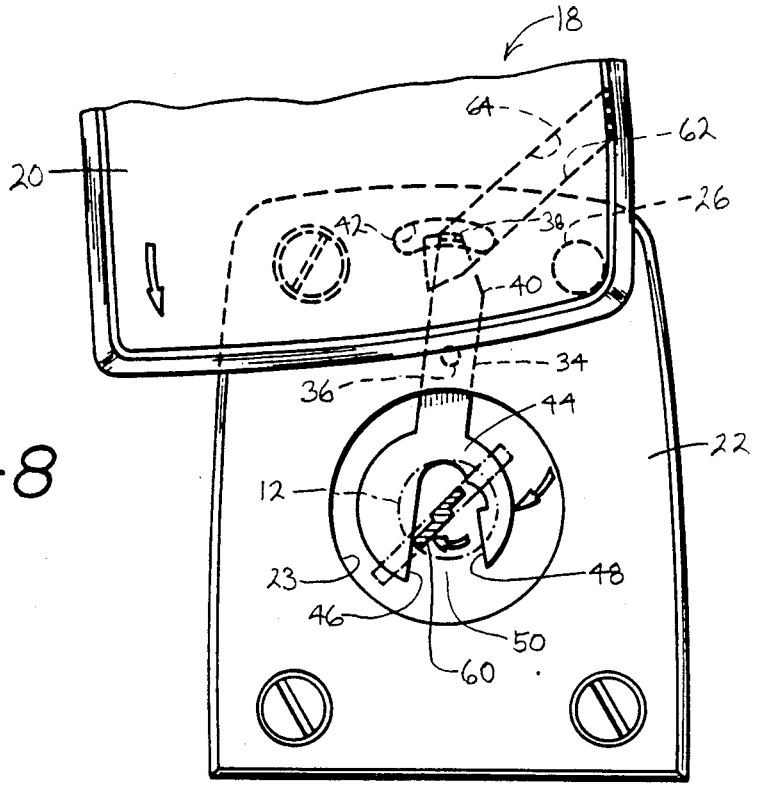
FIG. 8 is a front view, similar to FIG. 7, illustrating movement of the stop away from the first point by rotation of the key.
Figure 9:
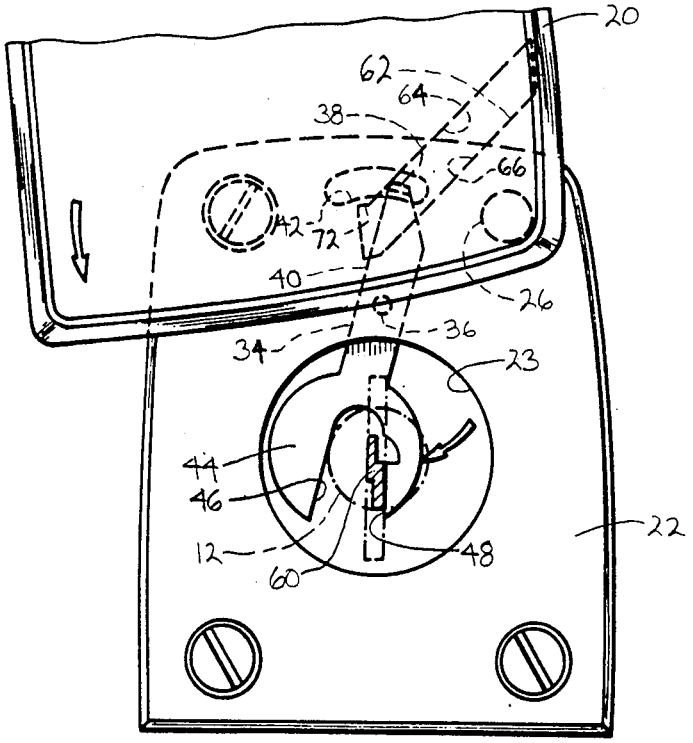
FIG. 9 is a front view, similar to FIG. 7, illustrating engagement of the cover plate by the stop at a second point.
Figure 10:
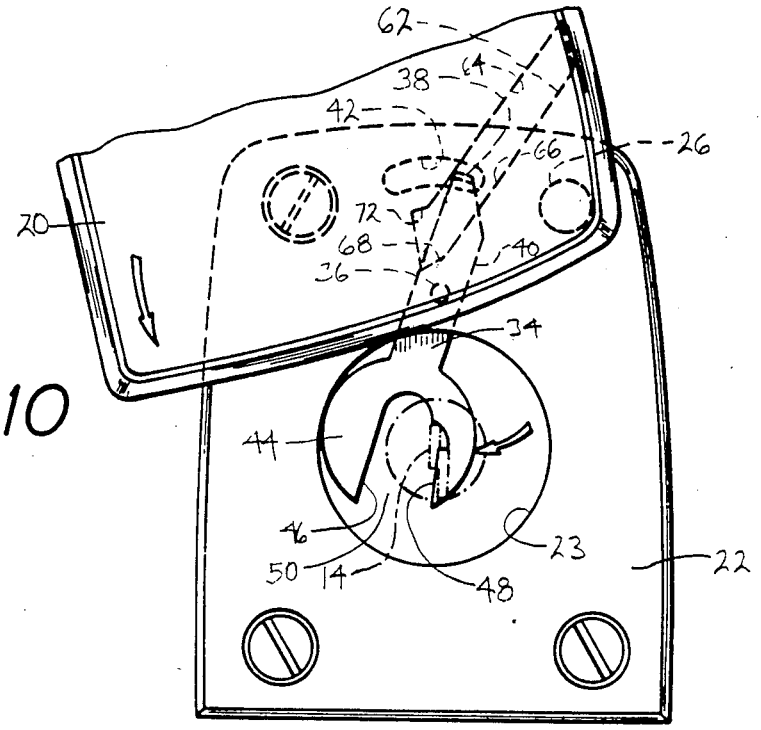
FIG. 10 is a front view, similar to FIG. 7, illustrating movement of the stop away from the second point by withdrawal of the key.

A key 60 may then be inserted into the lock opening 14 through the access opening 23 and pivoted to actuate the lock, as shown in FIG. 8. Pivoting key 60 also brings the key into contact with contact surface 46, pivoting detent member 34 in a clockwise direction. Since the cover plate 20 is no longer held in its opened position by stop 38 contacting surface 72, cover plate 20 pivots in a counter-clockwise direction and begins to close. Stop 38 slides along wall 64 of groove 62 until contact surface 48 strikes the side of key 60, as shown in FIG. 9. Key 60 then prevents further rotation of detent member 34, and stop 38 in contact with wall 64 thereby precludes further movement of plate 20 in a counter-clockwise direction. When key 60 is removed from the lock, however, detent member 34 is released such that it can pivot freely in a clockwise direction, as shown in FIG. 10, releasing cover plate to pivot into its closed position as shown in FIG. 11.

It may be desirable to modify the embodiment of FIGS. 7–11 to permit the cover plate 20 to be manually pivoted from its opened position (FIG. 7) to its closed position (FIG. 11). To permit such a manual closing of plate 20, the stop 38 is bent downward slightly, such that it forms an angle of less than 90° with leg 40. Leg 40 is formed of a thin flexible metal material. As a consequence, the manual application of a closing force to the plate 20 causes the leg 40 to be cammed rearwardly by the inclined surface of stop 38 in contact with surface 72. The stop 38 is deflected out of the groove 62, permitting the cover plate 20 to be closed. As the cover plate 20 moves back into its closed position, the stop 38 falls back into the groove 62, as shown in FIG. 11.

The embodiment of FIGS. 7–11 is advantageous in that the spring 52, used in the first embodiment, is not required. Additionally, the contact force between the stop 38 and the walls 64 and 66 of groove 62 is somewhat reduced, thereby facilitating the pivotal movement of the cover plate 20.

Having described the invention in detail and by reference to preferred embodiments thereof, it will be apparent that modifications and variations are possible without departing from the scope of the invention defined in the appended claims.

What is claimed is:

1. A cover mechanism for covering a lock, including a lock cylinder having a key opening, mounted on a lock support surface, comprising:

cover plate means, including a cover plate, pivotally mounted on a support plate secured to said lock support surface, for rotation generally in the plane of said support plate between a closed position in which said lock is covered, and an opened position in which said lock is exposed for insertion of a key into said key opening, and plate detent means comprising a detent member pivotally mounted on said support plate, said detent member including a contact portion defining first and second key contact surfaces on opposite sides of said key opening, whereby said detent member can engage said cover plate at a first point after said cover plate is pivoted into its opened position, said key can engage said first contact surface of said detent member for moving said detent member out of engagement with said first point as said key is rotated from its initial position to its unlatching position, and said second contact surface can contact said key to permit said detent member to engage said cover plate at a second point to maintain said cover plate in an open position until said key is removed from said key opening, the disengagement of said key from said second contact surface permitting said cover plate to be rotated into said closed position.

2. A cover mechanism for covering a lock, including a lock cylinder having a key opening, mounted on a lock support surface, comprising a support plate secured to said lock surface, said support plate defining an access opening aligned with said key opening, a cover plate means, including a cover plate pivotally mounted to said support plate for rotation generally in the plane of said support plate between a closed position in which said lock is covered, and an opened position in which said lock is exposed for insertion of a key into said key opening, said cover plate further including a spring means for spring biasing said cover plate toward said closed position, said cover plate defining a channel in the side thereof facing said support plate, and plate detent means comprising a detent member pivotally mounted on said support plate, said detent member including a leg having a stop thereon extending into said channel and further including a contact portion defining a pair of key contact surfaces on opposite sides of a key aperture therein, said contact portion being generally aligned with said access opening, and said plate detent means further comprising a spring which pivotally biases said detent member to bring said stop into contact with said first and second points in said channel, whereby said key contacts the first of said key contact surfaces and moves said stop out of contact with said first point as said key is rotated, said detent member being held with said stop against said second point by contact of the second of said contact surfaces with said key, and whereby withdrawal of said key from said key opening permits said stop to move out of contact with said second point and allows said cover to rotate into its closed position.

3. The cover mechanism of claim 2 in which said channel is generally straight, with said second point defined on a wall surface of said channel, and with said channel having a notch at an end thereof defining said first point.

4. The cover mechanism of claim 2 in which said contact portion defines an open ended key aperture between said key contact surfaces.

5. A cover mechanism for covering a lock, having a key opening and mounted on a lock support surface, comprising:

a cover plate means, including a cover plate, pivotally mounted on a support plate secured to said lock support surface, for rotation generally in its plane between a closed position in which the key opening is covered and an opened position in which the key opening is exposed, said cover plate means further including spring means for spring biasing said cover plate toward said closed position, said cover plate defining a groove on the side of the cover plate facing said support plate, said groove defining a notch at one end thereof, and a detent member, pivotally mounted on said support plate, for engaging said cover plate to hold said cover plate in its opened position until withdrawal of said key from said key opening, said detent member comprising a leg defining a stop which extends into said groove and engages said notch to hold said cover plate in its opened position, said detent member further comprising a contact portion defining a first contact surface adjacent said key opening, whereby rotation of a key in said key opening brings said key into contact with said first contact surface thereby pivoting said detent member and disengaging said stop from said notch.

6. The cover mechanism of claim 5 in which said contact portion further comprises a second contact surface for contacting a key in said key opening after disengagement of said stop from said notch, whereby further pivotal movement of said detent member is prevented and said stop maintains contact with the wall of said groove to hold said cover plate in its opened position.

7. The cover mechanism of claim 6 further comprising a spring connected between said leg and said support plate to spring bias said detent member so as to urge said stop into engagement with said notch when said cover plate means is pivoted into its opened position.

8. The cover mechanism of claim 6 in which said notch is defined by a first wall of said groove and in which said second wall of said groove, generally opposite to said first wall, cams said stop into said notch when said cover plate is moved into said opened position.

9. The cover mechanism of claim 8 in which said first and second contact surfaces are positioned on opposite sides of a key aperture defined by said contact portion, said key aperture being aligned with said key opening when said stop engages said notch.

10. The cover mechanism of claim 9 in which said detent member is pivotally mounted on the side of said support plate opposite said cover plate and in which said stop extends through a slot in said support plate into said groove.

11. The cover mechanism of claim 8 in which said first and second contact surfaces are positioned on opposite sides of a key aperture defined by said contact portion, said key aperture being aligned with said key opening when said stop engages said notch.

12. The cover mechanism of claim 11 in which said detent member is pivotally mounted on the side of said support plate opposite said cover plate and in which said stop extends through a slot in said cover plate into said groove.

13. A cover mechanism for covering a lock, including a lock cylinder having a key opening, mounted on a lock support surface, comprising:

a cover plate means, including a cover plate pivotally mounted on a support plate secured to said lock support surface, said cover plate being movable between a closed position in which the key opening is covered and an opened position in which said key opening is exposed for insertion of a key thereinto, and said cover plate means further comprising spring means for spring biasing said cover plate toward said closed position, said cover plate defining a channel on the side thereof facing said support plate, and a detent member, pivotally mounted on said support plate, and including a stop extending into said channel, said detent member having a contact portion defining a pair of key contact surfaces on opposite sides of a key aperture, whereby upon movement of said cover plate into said opened position said stop is brought into contact with a first point in said channel to hold said cover plate in said opened position, upon rotation of a key in said key opening said detent member is pivoted by contact between a first of said pair of key contact surfaces and said stop is moved out of contact with said first point and into contact with a second point in said channel, said detent member then being held in place by contact of the second of said contact surfaces against said key and said cover plate being held in its opened position by contact of said stop against said second point in said channel, and upon withdrawal of the key from the key opening, said cover plate is released to move into its closed position.

14. The cover mechanism of claim 13 in which said channel is generally straight with a notch at the end thereof defining said first point.

15. The cover mechanism of claim 14 in which said second point is defined along the wall of said channel intermediate its ends.

16. The cover mechanism of claim 15 in which said stop is brought into position in said notch upon opening of said cover plate by virture of the camming of said stop against the wall of said channel.

17. The cover mechanism of claim 15 further comprising a spring for biasing said stop into position in said notch upon movement of said cover plate into its opened position.

* * * * *